US012577038B2

(12) United States Patent
Navalón Simón et al.

(10) Patent No.: US 12,577,038 B2
(45) Date of Patent: Mar. 17, 2026

(54) FOLDING TRANSPORT CONTAINER

(71) Applicant: NAVLANDIS, S.L., Valencia (ES)

(72) Inventors: Miguel Antonio Navalón Simón, Valencia (ES); Vicent Arnandis Vallés, Valencia (ES); Andrés Revert Santamaría, Valencia (ES)

(73) Assignee: NAVLANDIS, S.L., Valencia (ES)

( * ) Notice: Subject to any disclaimer, the term of this patent is extended or adjusted under 35 U.S.C. 154(b) by 0 days.

(21) Appl. No.: 18/555,715

(22) PCT Filed: Mar. 29, 2022

(86) PCT No.: PCT/ES2022/070178

§ 371 (c)(1),
(2) Date: Oct. 16, 2023

(87) PCT Pub. No.: WO2022/223858

PCT Pub. Date: Oct. 27, 2022

(65) Prior Publication Data

US 2024/0199319 A1 Jun. 20, 2024

(30) Foreign Application Priority Data

Apr. 21, 2021 (ES) ..... ES202130355

(51) Int. Cl.
*B65D 88/52* (2006.01)

(52) U.S. Cl.
CPC ..... *B65D 88/522* (2013.01)

(58) Field of Classification Search
CPC ..... B65D 88/522; B65D 88/121; B65D 7/30; B62D 63/061
See application file for complete search history.

(56) References Cited

U.S. PATENT DOCUMENTS

| | | | | |
|---|---|---|---|---|
| 3,799,384 | A | 3/1974 | Hurkamp | |
| 2010/0018967 | A1 | 1/2010 | Schrayvogel | |
| 2014/0175090 | A1* | 6/2014 | Bellehumeur | B65D 90/022 220/1.5 |
| 2014/0231422 | A1* | 8/2014 | Kochanowski | E05D 11/1007 220/1.5 |
| 2016/0251153 | A1* | 9/2016 | Navalon | B65D 88/522 220/1.5 |
| 2017/0057739 | A1* | 3/2017 | Kochanowski | B65D 90/0026 |
| 2017/0247184 | A1* | 8/2017 | Heskamp | B65D 88/121 |
| 2020/0079582 | A1 | 3/2020 | Press et al. | |
| 2022/0242660 | A1* | 8/2022 | Schouten | B65D 88/522 |

* cited by examiner

*Primary Examiner* — Shawn M Braden
(74) *Attorney, Agent, or Firm* — DUANE MORRIS LLP

(57) ABSTRACT

A laterally collapsible container (111) comprising a pair of side walls (114, 115), at least one pair of hinged end panels (116), a top wall (113) and a bottom wall (112), wherein one end of a vertical side wall (114, 115) is mechanically coupled to the corresponding vertical side edge of a hinged end panel (116) through a hinged push-pull connection (211) comprising at least a first piece (123) and at least a second piece (212) that are joined together through an intermediate piece (213), to allow the hinged end panels (116) to be attached to the corresponding outer side surface of a vertical side wall (114, 115), where the hinged end panel (116) can describe a rotational movement between 0°, which corresponds to the hinged end panel (116) in the closed position, and 270°, which corresponds to the hinged end panel (116) in the fully open position.

10 Claims, 6 Drawing Sheets

FOLDING TRANSPORT CONTAINER

CROSS-REFERENCE TO RELATED APPLICATIONS

This application is a § 371 national stage entry of International Application No. PCT/ES2022/070178, filed Mar. 29, 2022, which claims priority to Spain Application No. P202130355, filed Apr. 21, 2021, the entire contents of which are incorporated herein by reference.

OBJECT

The present invention relates to a collapsible shipping container that is used for the maritime and land shipment of goods on a global scale.

STATE OF THE ART

In the field of the art the need to transport empty containers from large consumer markets to large-scale production and manufacturing areas is well known. In order to reduce the cost of transporting empty containers, collapsible containers have been developed.

These containers can be folded so that they are folded when empty, and take up a considerably smaller volume than in their assembled or erected state, allowing these containers to be transported more efficiently when empty.

There are strict regulations, for example, standard ISO-1496 and the CSC—International Convention for Safe Containers—which describe the tests for structural strength, compressive and tensile loads, as well as transverse tests, that must be passed by cargo containers. In the case of a collapsible shipping container these structural tests must be passed both in a vertical unfolded configuration and in a horizontal folded configuration.

On the one hand, the folding container in its unfolded configuration needs to harmonise the necessary structural resistance of the regulations, with compatibility with the folding-unfolding movement.

On the other hand, the folding container in the folded configuration must harmonise the necessary structural strength with the geometry of the container, in a position where the structural frame of the container is not braced by the closed doors, which in the folded position are not assembled.

Therefore, the collapsible container must have a geometric compatibility with the folding and unfolding movement, meet rigidity and structural strength requirements to be able to pass the tests included in the aforementioned standard, both in the unfolded configuration and in the folded configuration.

The collapsible container requires the provision of reinforcements that ensure that the collapsible container both in the assembled or disassembled state is able to meet the safety requirements established by the safety standards applicable to this type of shipping container, but at the same time, respect the geometric conditions of the standard shipping container.

SUMMARY

The present invention aims to resolve one or more of the drawbacks outlined above by means of a collapsible shipping container as is defined in the claims.

The collapsible shipping container comprises a pair of side walls, laterally slidable with respect to the bottom and the top, at least one pair of hinged end panels, a top wall or ceiling and a bottom wall or floor, wherein an end portion of a side wall is mechanically coupled to the corresponding vertical side edge of a hinged end panel through a hinged push-pull connection. In other words, this panel is distanced from the corresponding vertical side edge of a side wall.

The hinged push-pull connection comprising at least a first part and at least a second part that are attached to each other through an intermediate part, to allow the hinged end panels to be attached to the corresponding outer side surface of a side wall. The hinged end panel can describe a rotational movement between 0°, which corresponds to the hinged end panel in the closed position, and 270°, which corresponds to the hinged end panel in the fully open position.

The collapsible shipping container is movable between a vertical unfolded configuration, wherein the side walls and the hinged end panels are arranged in a plane substantially perpendicular to the top wall and the bottom wall, and a horizontal folded configuration, wherein the side walls and the hinged end panels are arranged in a plane substantially parallel to the top wall and the bottom wall, in a sandwich configuration.

If the shipping container is moved from the vertical unfolded configuration to the horizontal folded configuration or vice versa, the shipping container adopts a configuration in a Z-shape.

The collapsible shipping container has an arrangement of the different elements of this shipping container that ensures compatibility with the folding-unfolding movements of this shipping container. The mechanical connection between the corresponding end portion of a side wall and the corresponding vertical side edge of a hinged end panel is made through the hinged push-pull connection, which forms two pivotal connections between the first part and the intermediate part, and between the second part and the intermediate part, performing a double-acting push-pull hinge function.

The push-pull hinged connection provides support and guidance to the hinged end panels of the collapsible shipping container as the hinged end panels describe a swivelling or rotational movement from the closed position to the open position or vice versa.

The push-pull hinged connection acts as a door hinge assembly comprising a double set of parallel, vertically facing hinges connected to each other by means of the intermediate piece which is coupled by a first vertical side edge to the first piece and by a second vertical side edge opposite the first vertical side edge to the second piece.

In the fully open position of the hinged end panel, this panel is distanced from the corresponding vertical side edge of a side wall, to allow the collapsible shipping container to be moved from the vertical unfolded configuration towards the horizontal folded configuration or vice versa, allowing compatibility with the folding-unfolding movements of this shipping container.

When the laterally foldable shipping container is arranged in the folded configuration, a hinged end panel is stored between a side wall and the corresponding top wall or bottom wall, in a sandwich configuration.

The push-pull articulated connections in the vertical unfolded configuration are capable of transmitting stresses in the same way as the hinges of a standard shipping container and, in addition, if the shipping container is moved from the vertical unfolded configuration towards the horizontal folded configuration or vice versa, it allows the hinged end panels to be attached to the side walls of the shipping container, in a position in which there is no collision with other parts of the shipping container during the folding and unfolding movements.

The hinged end panel is held in an open position by a latch or similar device to hold the hinged end panel in place, so that, when the collapsible shipping container is moved between the folded configuration and the unfolded configuration, the hinged end panels are kept attached to the side walls and distanced from the top and bottom walls, i.e., the hinged end panels do not contact the top wall or bottom wall without compromising the integrity and safety of these hinged panels or any other part of the collapsible shipping container.

The push-pull hinge connection allows maintaining the door width of the unfolded shipping container and thus provides rigidity to the unfolded shipping container, but in order to provide additional rigidity to the unfolded shipping container, this collapsible shipping container comprises at least one pair of stiffeners arranged at opposite corners, i.e. at non-consecutive vertices of an end plane of the collapsible shipping container in its unfolded configuration.

The stiffener comprises a U-shaped bracket, a pin and at least one plate with a through-slot. If the hinged end panel is in closed position and the stiffener is in working or mounted position, the plate is fitted inside the U-shaped bracket, being held in this position by the pin inserted inside the through slot of the plate.

The stiffener adopts a rest or unlock position if the hinged end panels are in the open position to perform the folding-unfolding process, but are compatible to remain locked in the ordinary opening and closing operations of doors.

The hinged end panels, in closed position, are lockable by means of at least one extendable closing bar, comprising a lower closing and upper closing portion and a hollow cylindrical central closing portion and a handle per hinged end panel.

When the hinged end panels are in the open position for the folding-unfolding process, the extendable closure bar allows the introduction of both opposite lower and upper portions, when inserted through the central portion, in other words, the portions are arranged telescopically, such that, the vertical length of the contracted extendable closure bar is less than the vertical length of the hinged end panel, to avoid collisions that would make the folding of the shipping container unfeasible when moving the upper part towards the bottom of the container or vice versa.

The extendable or telescopic closing bar provides an improvement in the strength of the collapsible shipping container, to gather the loads determined by the aforementioned regulations, with the shipping container unfolded.

The folded shipping container can be locked in the folded configuration, sandwich configuration, against vertical movements by means of at least one vertical locking plate rotatable from 0°, corresponding to a horizontal parallel position to the upper edge of the upper part of the shipping container, to 90°, corresponding to a vertical position to a lateral vertical edge of the side panel of the shipping container. Consequently, if the locking plate is rotated 90° the shipping container is folded and locked in this sandwich configuration.

The rotatable vertical locking plate is attached close to a corner formed by the convergence of the top and a side wall of the collapsible container.

A pair of rotatable vertical locking strips are attached at corresponding opposite corners of the top of the shipping container. If both rotatable vertical locking plates are rotated 90° and are in a vertical or working position, the resistance of the folded shipping container, in this sandwich configuration, passes the tensile and compression stress tests set by the current standard shipping container regulations.

The rotatable vertical locking strips, when arranged in locking position provide sufficient tensile strength to withstand the lifting stresses of at least two folded and stacked shipping containers.

The folded shipping container can be locked in this configuration against horizontal movements by means of at least one rotatable diagonal locking element as well.

The diagonal locking element is rotatable between 0°, corresponding to a horizontal parallel position to the lower edge of the bottom of the folded container, and an angle of less than 90°, corresponding to a diagonal position from the lower edge of the bottom of the folded container towards the upper edge of the top of the container in the sandwich configuration.

In other words, the lower end of the rotatable diagonal locking element is attached to the horizontal side edge of the bottom wall and the upper end opposite the lower end of the rotatable diagonal locking element is attached to the horizontal side edge of the top wall.

If two diagonal locking elements are arranged in the same vertical plane when the corresponding upper ends are rotated towards the horizontal lateral edge of the upper wall, the two diagonal locking elements adopt a San Andres cross shape corresponding to the working position, therefore, the resistance of the folded shipping container, in a sandwich configuration, passes the lateral stress tests set by the current regulations of the shipping containers, without the need to increase the dimensions of the pillars nor reduce the passage spaces.

The joint action of the rotatable vertical locking plates and the rotatable diagonal locking elements also makes it possible to improve the structural strength of the collapsible shipping container in the collapsed configuration. Ensuring the resistance against both vertical and horizontal stresses of each folded shipping container unit, in turn, ensures the resistance against the same stresses of the stack of folded containers, connected to each other vertically with the standard connection devices or twistlocks, is achieved.

Therefore, several collapsible shipping containers can be easily stacked, and are able to withstand the vertical compressive and tensile stresses, and horizontal stresses indicated by the current regulations applicable to the standard container, and occupy much less space than in the unfolded configuration. For example, five folded shipping containers occupy a similar space as one unfolded shipping container.

On the other hand, the joint action of the position of the push-pull articulated connections, the stiffener and the extendable closing bars of the hinged end panels allows the improvement of the structural strength of the foldable shipping container in its unfolded configuration, making it compatible with the folding and unfolding movement.

The predetermined location of the push-pull hinged connection, which, with joints, connects the hinged end panels or doors with the side wall, as well as the stiffener which fixedly connects the hinged end panels with the bottom and to the top of the collapsible shipping container, allows at least to maintain the adequate strength contribution if the shipping container is assembled, but allows disconnecting the hinged end panels from the top and from the bottom if the shipping container is moved from the vertical unfolded configuration towards the horizontal folded configuration or vice versa. In this way, the hinged end panels can be attached to the side walls, without preventing the folding of the shipping container with the movement of the upper part towards the lower part of the container or vice versa.

As a result, the folding and unfolding procedures of the collapsible shipping container are simplified as much as possible, and are carried out in a safe and reliable manner.

BRIEF DESCRIPTION OF THE FIGURES

A more detailed explanation of the invention in accordance with the embodiments thereof is given in the description below, based on the attached figures in which.

DETAILED DESCRIPTION

Figure 1:
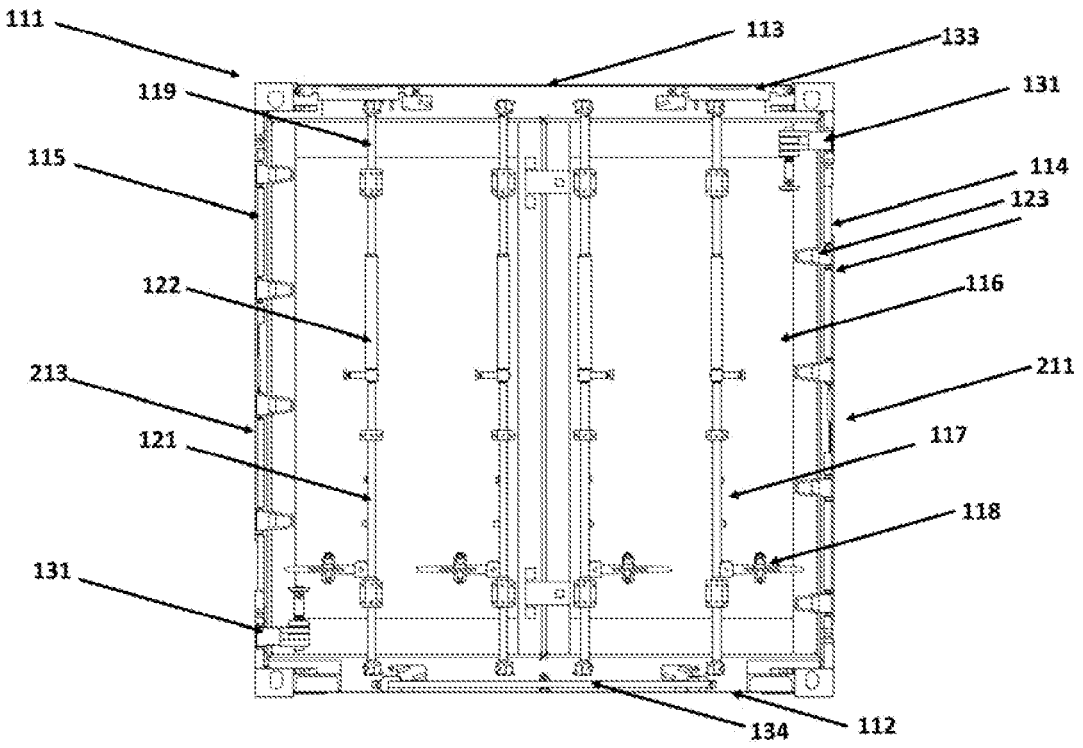
FIG. 1 shows an elevation view of a pair of end panels or hinged doors of a laterally foldable shipping container, in a vertical unfolded configuration, in a closed position.
Figure 2:
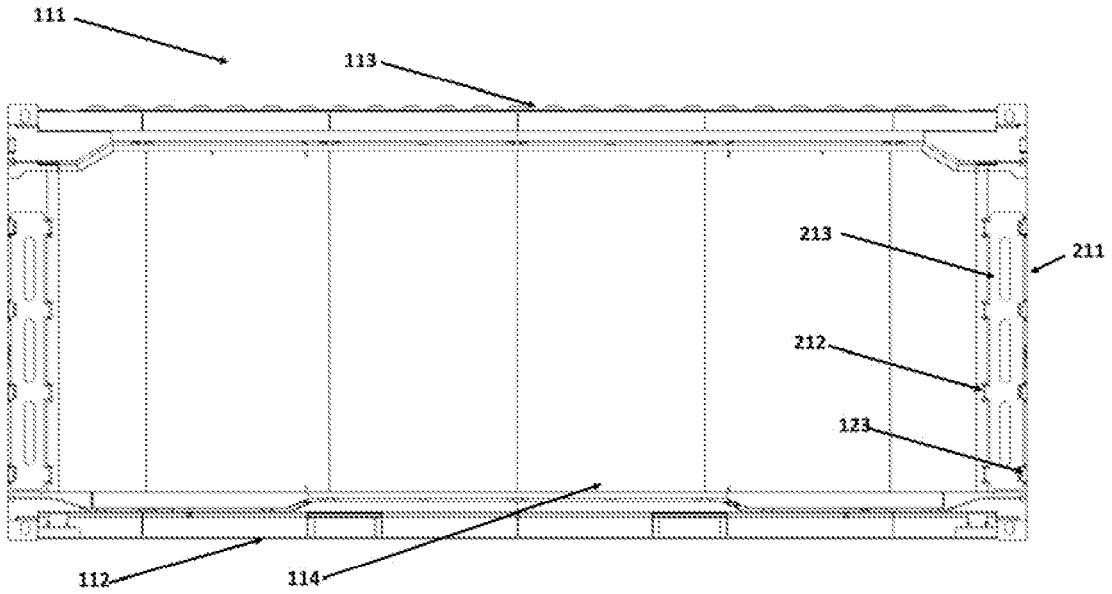
FIG. 2 shows, in profile view, a side wall of the laterally foldable shipping container in a vertical unfolded configuration, where the hinged end panels are in a closed position, a first hinged push-pull connection is attached to a first side edge of the side wall and a second hinged push-pull connection is attached to a second vertical side edge opposite the first vertical side edge of the side wall.

With reference to FIGS. 1 to 6 where a laterally foldable shipping container 111 is shown.

The collapsible shipping container 111 comprises a pair of side walls 114, 115, at least a pair of end panels or hinged doors 116, a top wall or ceiling 113, and a bottom wall or base 112.

The laterally foldable shipping container 111 is displaceable or movable between a vertical unfolded configuration towards a horizontal folded configuration or vice versa, such that, the foldable shipping container 111 assumes an intermediate Z-shaped configuration by laterally sliding the side walls 114, 115 with respect to the lower part 112 and the upper part 113.

Figure 7:
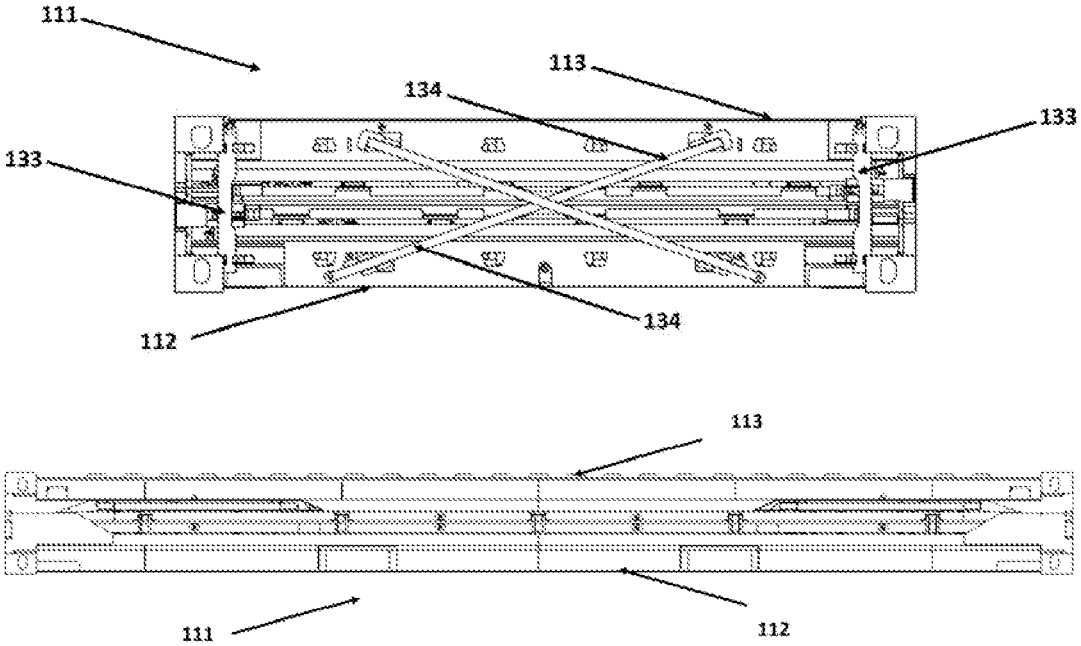
FIG. 7 shows an elevation and rear profile view of the laterally foldable shipping container in a folded configuration in a sandwich configuration.
Figure 8:
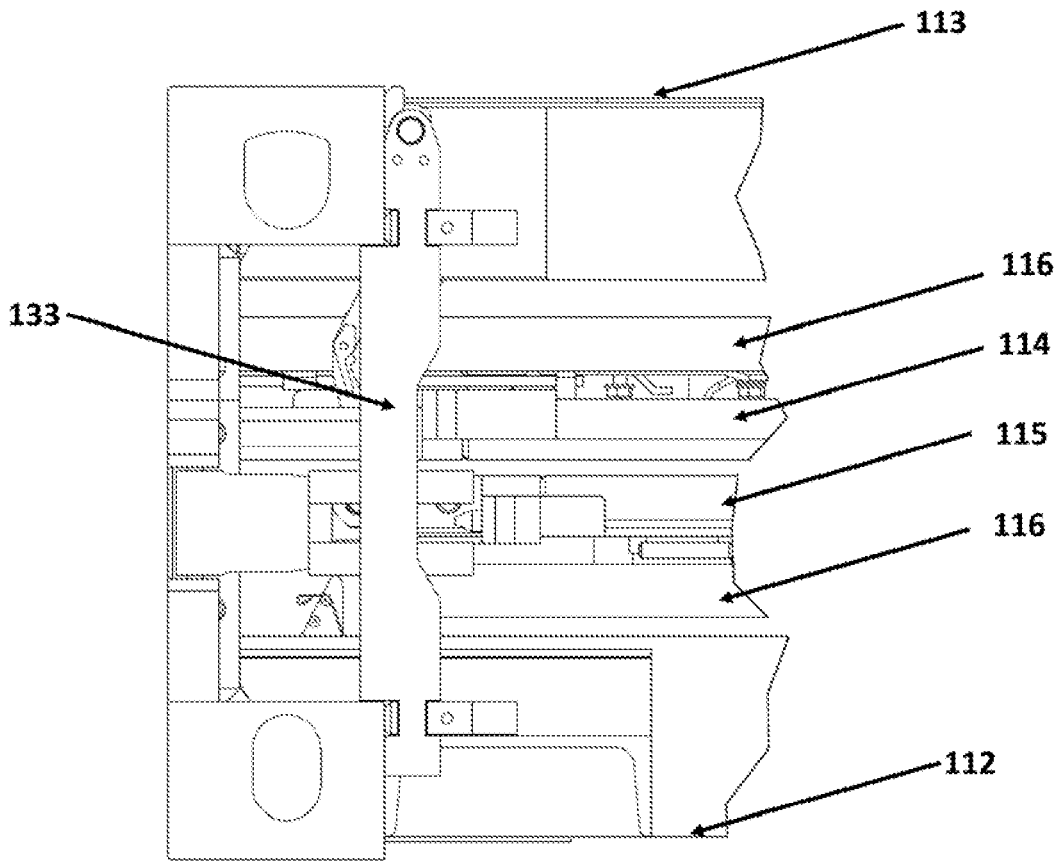
FIG. 8 shows an elevation view of a first detail of a vertical side of the laterally foldable shipping container in the folded configuration in sandwich configuration of FIG. 7.
Figure 9:
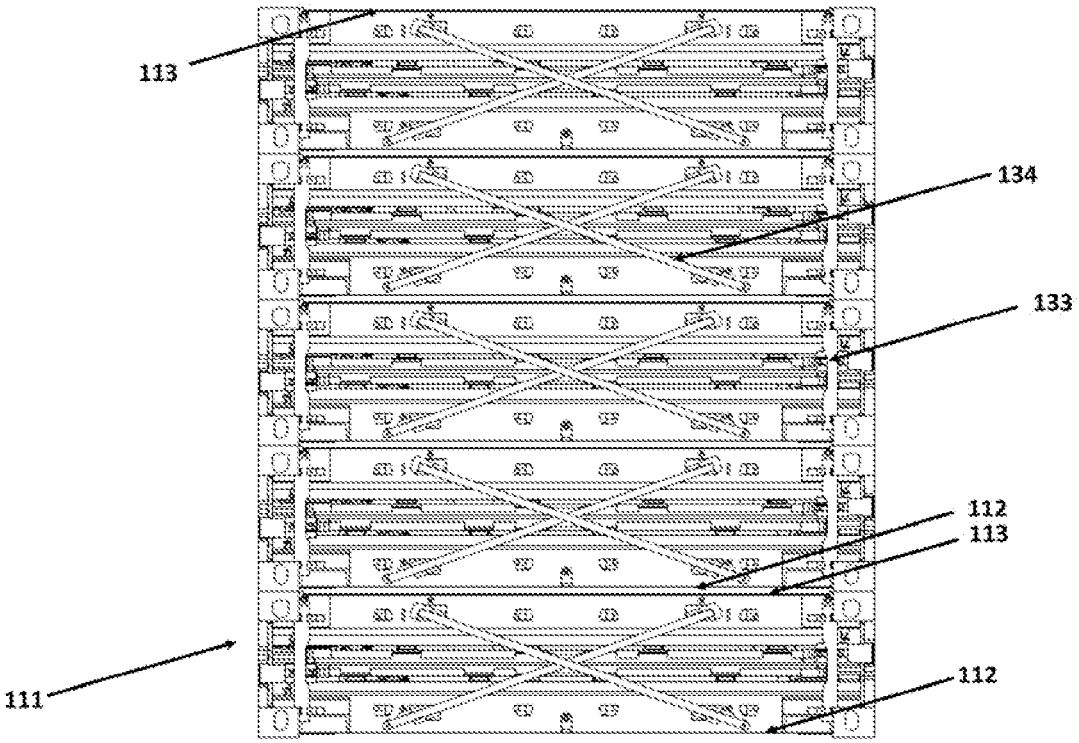
FIG. 9 shows an elevation view of a laterally foldable shipping container stack in the folded configuration in a sandwich configuration.

In the vertical unfolded configuration of the collapsible shipping container 111, the side walls 114, 115, and the hinged end panels 116 are substantially perpendicular to the top wall 113 and the bottom wall 112. As shown in FIGS. 7-9, in the horizontal folded configuration, the sidewalls 114, 115 and the hinged end panels 116 are essentially parallel to the top 113 and bottom 112 walls.

Each end of a vertical sidewall 114, 115 is mechanically coupled to the corresponding vertical side edge of a hinged end panel 116 via a push-pull hinge connection 211.

Figure 6:
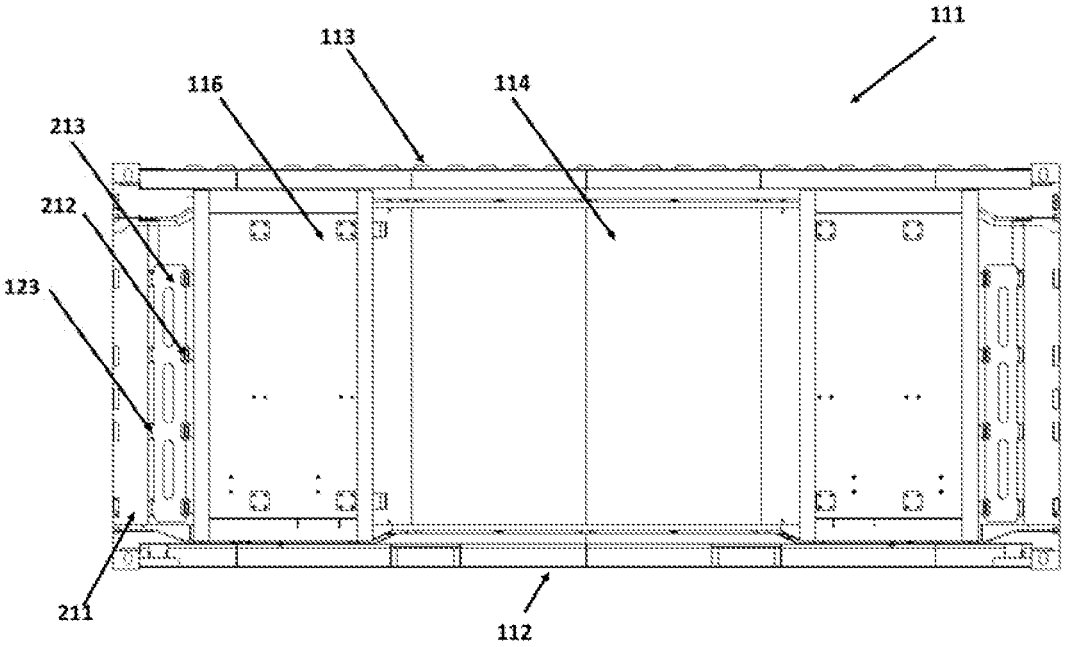
FIG. 6 shows in a profile view a side wall of the laterally foldable shipping container in the upright unfolded configuration, where the hinged end panels are, in the open position, attached to a side wall of the shipping container.

Referring now to FIGS. 1 and 6, the push-pull connection 211 comprises at least a first piece 123 and at least a second piece 212 which are joined to each other via an intermediate piece 213 such that two pivotal connections are formed between the first piece 123 and the intermediate piece 213 and between the second piece 212 and the intermediate piece 213. Thus, the push-pull connection 211 performs a double-acting push-pull hinge function.

The push-pull articulated connection 211 couples the vertical side wall 114, 115 to the corresponding hinged end panel 116. In general, the hinged end panels 116 in pairs are the doors of the foldable shipping container 111, through the hinged doors 116 the foldable shipping container 111 can be accessed when in the upright unfolded configuration. Generally, the door can be locked.

The first piece 123 is fixed to the outer side surface of a hinged end panel 116. The second piece 212 is fixed to the outer side surface of an upright side wall 114, 115.

The first piece 123 is attached to a first vertical side edge of the intermediate piece 213 by means of a first longitudinal axis that allows the rotation of both pieces or of the first piece 123 on the intermediate piece 213 or vice versa.

Similarly, the second part 212 is attached to a second vertical side edge opposite the first vertical side edge of the intermediate piece 213 by means of a second longitudinal axis parallel to the first axis, which allows the rotation of both pieces or of the intermediate piece 213 on the second piece 212.

The push-pull hinge connection 211 allows the hinged end panels 116 to be attached to the corresponding outer side surface of a vertical side wall 114, 115, such that the hinged end panel 116 can describe a rotational movement between 0°, which corresponds to the hinged end panel 116 in the closed position, and 270°, which corresponds to the hinged end panel 116 in the fully open position.

In the fully open position of the hinged end panel 116, this panel 116 is distanced from the corresponding vertical side edge of a vertical side wall 114, 115.

If the hinged end panel 116 is in the open position, i.e., attached externally to the outer side surface of a vertical side wall 114, 115, the collapsible shipping container 111 is movable from the vertical unfolded configuration to the horizontal folded configuration or vice versa. The collapsible shipping container 111 adopting a Z-shaped intermediate configuration.

If the laterally folded shipping container 111 is arranged in the folded configuration, a hinged end panel 116 is stored between a vertical side wall 114, 115 and the corresponding top wall 113 or bottom wall 112 in a sandwich configuration, FIG. 7.

The hinged end panel 116 is held in an open position by a latch or similar device to hold the hinged end panel 116 in place for the folding-unfolding process.

Referring now to FIG. 9, where it is shown that a number of collapsible shipping containers 111 can be easily stacked and take up much less space than in the unfolded configuration. For example, four folded shipping containers 111 occupy a similar space as an unfolded shipping container.

The collapsible shipping container 111 in a vertically unfolding configuration wherein the hinged end panels 116 are connected by the push-pull hinged connection 211 to the side walls 114, 115, exhibits adequate rigidity to meet the requirements of ISO-1496 and CSC, the International Convention for Safe Containers.

Furthermore, the collapsible shipping container 111 comprises at least one reinforced corner piece having a larger transverse dimension than a corner piece corresponding to a non-collapsible shipping container, to help support eccentricities of stacking loads of at least two stacked collapsible shipping containers.

To provide rigidity to the hinged end panels 116 in closed position, the collapsible shipping container 111 further comprises at least one pair of stiffeners 131 arranged at opposite corners, i.e. at non-consecutive vertices of an end plane of the collapsible shipping container 111 in unfolded configuration.

The stiffener 131 comprises a U-shaped bracket, a pin 132 and at least one through-slotted plate. If the end panel 116 is in closed position and the stiffener 131 is in stiffening or mounted position, the plate is fitted inside the U-shaped bracket, being held in this position by the pin 132 inserted inside the through-slot of the plate.

Figure 3:
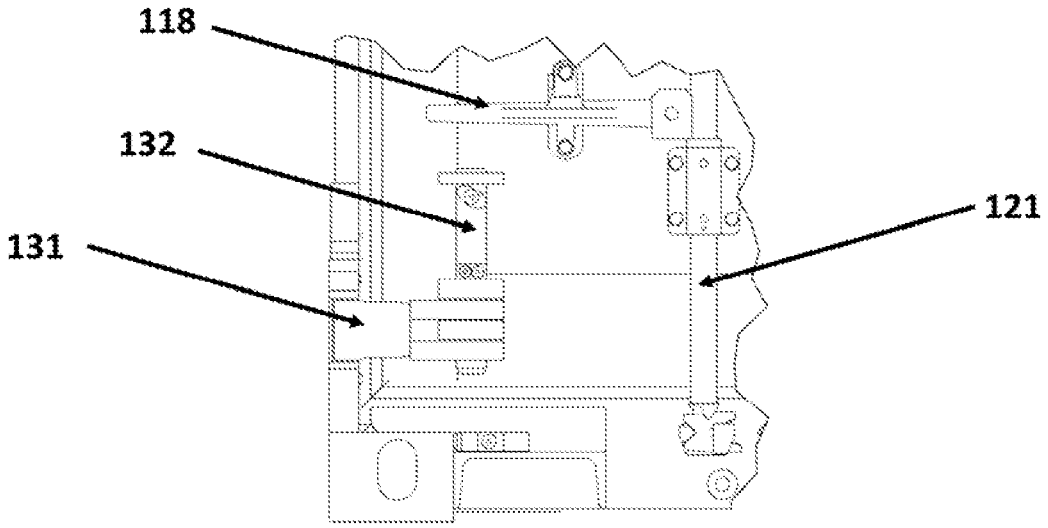
FIG. 3 shows, in elevation, the collapsible shipping container a first detail of a stiffener arranged in a corner of the laterally collapsible shipping container in the unfolded configuration of FIG. 1.
Figure 4:
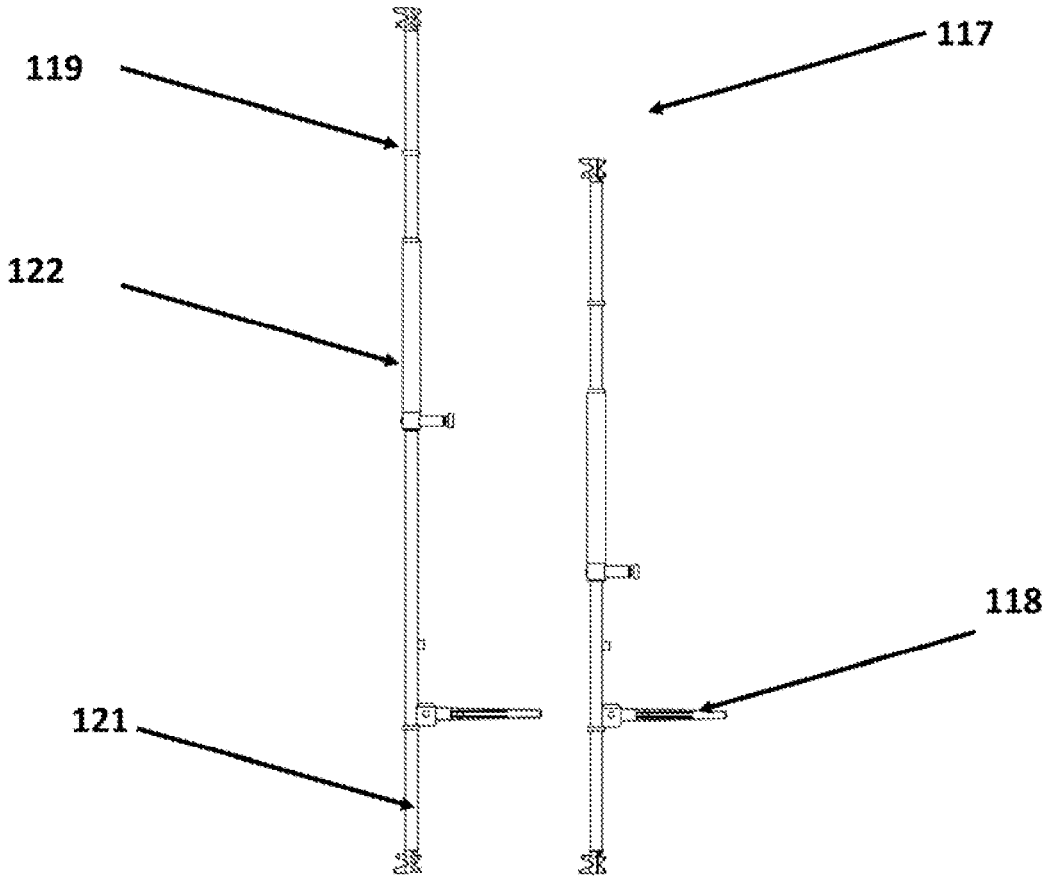
FIG. 4 shows an elevation view of an extendable closure bar, which is attached to the outer face of a hinged end panel of the laterally foldable shipping container, in the extended closure bar configuration and in the contracted closure bar configuration.
Figure 5:
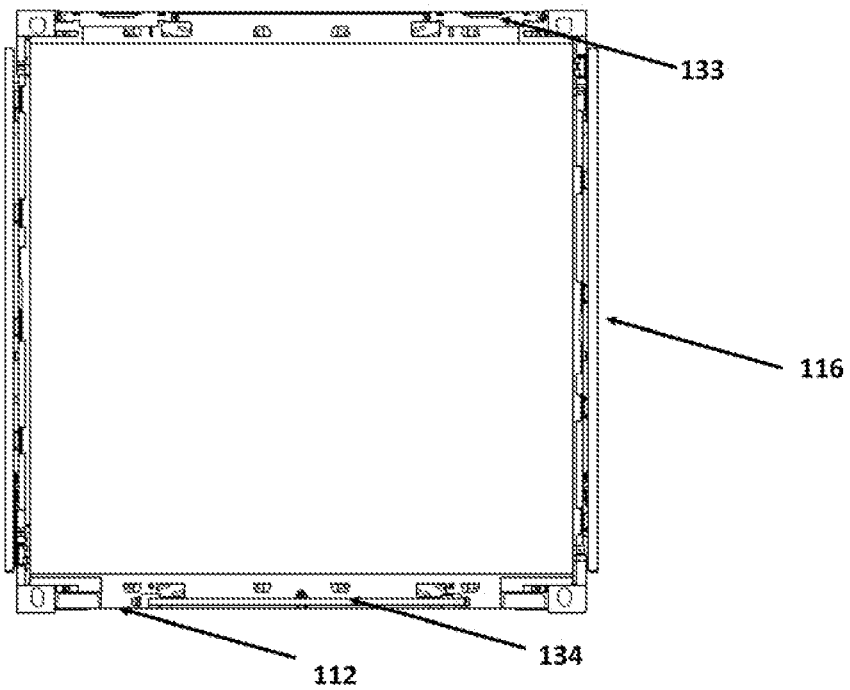
FIG. 5 shows a rear or front elevation view of the laterally foldable shipping container in the vertical unfolded configuration, where the hinged end panels are in the open position.

With reference to FIGS. 1, 3 and 4, the hinged end panels 116, in closed position, are lockable by means of at least one extendable closing bar 117. The extendable closing bar 117 comprises a lower closing portion 121 and upper closing portion 119 and a hollow cylindrical central closing portion 122, the upper and lower closing portions 119, 121 and the central portion 122 being arranged telescopically, and a handle 118 per end panel 116.

In the open position of the hinged end panels 116, the opposing lower and upper closure portions 121, 119 are insertable through into the central closure portion 122, such that the vertical length of the contracted extendible closure bar 117 is less than the vertical length of the hinged end panel 116.

The folded shipping container 111 is lockable in the folded configuration, by means of at least one vertical locking plate 133 rotatable from 0°, corresponding to a horizontal parallel position to the upper edge of the upper part 113 of the shipping container 111, to 90°, corresponding to a parallel vertical position to a lateral vertical edge of the vertical side panel 114, 115 of the shipping container 111.

The rotatable vertical locking plate 133 is attached close to a corner formed by the convergence of the upper part 113 and a vertical side wall 114, 115 of the collapsible container 111.

A pair of rotatable vertical locking strips 133 are attached at corresponding opposite corners of the top 113 of the shipping container 111.

The rotatable vertical locking plates 133 are attached to the corresponding horizontal side edge of the upper wall 113 and/or of the lower wall 112 that is placed in working position when it is desired to maintain the folding configuration of the shipping container 111 or is removed to a rest position if the shipping container 111 is unfolded vertically, so that it does not become an orphan piece with the obvious risk of being lost.

The folded shipping container 111 can be locked in this configuration against horizontal movements by means of at least one rotatable diagonal locking element 134 as well.

The diagonal locking element 134 is rotatable between 0°, corresponding to a parallel position horizontal to the lower edge of the lower portion 112 of the folded container 111, and an angle of less than 90°, corresponding to a diagonal position from the lower edge of the lower portion 112 of the folded container 111 towards the upper edge of the upper portion 113 of the container 111 in the sandwich configuration.

If two diagonal locking elements 134 are arranged in the same vertical plane when the corresponding upper ends of these diagonal locking elements 134 are rotated towards the horizontal side edge of the upper wall 113, the two diagonal locking elements 134 adopt a San Andrés cross shape corresponding to the working position corresponding to the folded shipping container 111.

Therefore, several foldable shipping containers can be easily stacked, and are able to withstand the vertical compressive and tensile stresses, and horizontal stresses, indicated by the current regulations, and take up much less space than in the unfolded configuration. For example, five folded shipping containers occupy a space similar to one unfolded shipping container.

Therefore, in the folded configuration of the foldable shipping container 111, the rotatable vertical locking strips 133, the diagonal locking elements 134, the upper wall 113 and the lower wall 112, provide compressive strength against stacking loads.

The diagonal element 134 is attached to the corresponding horizontal side edge of the lower wall 112 and/or of the upper wall 113 by means of an oscillating device, which is placed in working position when it is desired to maintain the folded configuration of the shipping container 111 or is removed to a rest position if the shipping container 111 is vertically unfolded, so that it does not become an orphan piece with an evident risk of being lost.

LIST OF NUMERICAL REFERENCES

111 collapsible shipping container
112 lower wall
113 upper wall
114, 115 vertical side walls
116 hinged end panels
117 extendable closing bar
118 handle
119 upper closing portion
121 lower closing portion
122 hollow central closing portion
131 stiffener
132 pin
133 rotatable vertical locking plate
134 rotatable diagonal locking element
211 push-pull hinged connection
123 first piece
212 second piece
213 intermediate piece

The invention claimed is:

1. A collapsable shipping container comprising a pair of side walls, at least one pair of end panels, a top wall, and a bottom wall, wherein one end of a side wall is mechanically coupled to a corresponding vertical side edge of a hinged end panel through a push-pull hinged connection, comprising at least a first piece and at least a second piece that are joined together through an intermediate piece, the first piece is fixed to the outer side surface of a hinged end panel and the second piece is fixed to the outer side surface of a side wall, the first piece is attached to a first vertical side edge of the intermediate piece by means of a first longitudinal axis that allows the rotation of both pieces or of the first piece on the intermediate piece or vice versa, the second piece is joined to a second vertical side edge opposite to the first vertical side edge of the intermediate piece by means of a second longitudinal axis parallel to the first axis, which allows the rotation of both pieces or of the intermediate piece on the second piece, wherein the collapsible shipping container comprises at least one pair of stiffeners arranged at opposite corners comprising non-consecutive vertices of an end plane of the collapsible container in unfolded configuration; wherein the stiffener comprises a U-shaped bracket, a pin and at least one through-slotted plate that is engageable within the U-shaped bracket, if the hinged end panel is in closed position, being held in this position by the pin inserted within the through-slot of the platen, wherein the hinged end panels, in closed position, are lockable by means of at least one extendable closing bar, comprising a lower end closing portion and an upper end closing portion and a hollow central closing portion, the upper and lower end closing portions and the central closing portion being arranged telescopically, and a handle per hinged end panel, wherein the folded shipping container is lockable in the folded configuration, by means of at least one vertical locking plate rotatable from 0°, corresponding to a horizontal parallel position to the upper edge of the top of the shipping container, to 90°, corresponding to a vertical parallel position to a lateral vertical edge of the vertical side panel of the shipping container, wherein the folded shipping container can be locked in this configuration by means of at least one rotatable diagonal locking element.

2. The collapsible shipping container according to claim 1, wherein the hinged push-pull connection allows the hinged end panels to be attached to the corresponding outer side surface of a side wall, wherein the hinged end panel can describe a rotational movement between 0°, which corresponds to the hinged end panel in the closed position, and 270°, which corresponds to the end panel in the fully open position.

3. The collapsible shipping container according to claim 2, wherein the hinged end panel, in the fully open position, is kept in the open position by means of a latch or a similar device and is distanced from the corresponding vertical side edge of a side wall.

4. The collapsible shipping container according to claim 1, wherein the laterally foldable container adopting an intermediate Z-shaped configuration, in the horizontal folded configuration, the side walls and the hinged end panels are essentially parallel to the top walls and bottom wall in a sandwich configuration.

5. The collapsible shipping container according to claim 1, wherein the opposite lower and upper closing portions are inserted through into the central closing portion in the open position of the hinged end panels.

6. The collapsible shipping container according to claim 1, wherein the rotatable vertical locking plate is attached close to a corner formed by the convergence of the top and a side wall of the collapsible container.

7. The collapsible shipping container according to claim 1, wherein the diagonal locking element is rotatable between 0°, corresponding to a horizontal parallel position to the lower edge of the lower portion of the folded container, and an angle less than 90°, corresponding to a diagonal position from the lower edge of the lower portion of the folded container towards the upper edge of the upper portion of the folded container.

8. The collapsible shipping container according to claim 7, wherein there are two diagonal locking elements and when the corresponding upper ends of these diagonal locking elements are rotated towards the horizontal side edge of the upper wall, the two diagonal locking elements adopt a San Andres cross shape corresponding to the working position, shipping container folded.

9. A collapsible shipping container comprising a pair of side walls, at least one pair of end panels, a top wall, and a bottom wall, wherein one end of a side wall is mechanically coupled to the corresponding vertical side edge of a hinged end panel through a push-pull hinged connection, comprising at least a first piece and at least a second piece that are joined together through an intermediate piece, the first piece is fixed to the outer side surface of a hinged end panel and the second piece is fixed to the outer side surface of a side wall, the first piece is attached to a first vertical side edge of the intermediate piece by means of a first longitudinal axis that allows the rotation of both pieces or of the first piece on the intermediate piece or vice versa, the second piece is joined to a second vertical side edge opposite to the first vertical side edge of the intermediate piece by means of a second longitudinal axis parallel to the first axis, which allows the rotation of both pieces or of the intermediate piece on the second piece, wherein the collapsible shipping container comprises at least one pair of stiffeners arranged at opposite corners comprising non-consecutive vertices of an end plane of the collapsible container in unfolded configuration, wherein the folded shipping container can be locked in this configuration by means of at least one rotatable diagonal locking element, wherein the diagonal locking element is rotatable between 0°, corresponding to a horizontal parallel position to the lower edge of the lower portion of the folded container, and an angle less than 90°, corresponding to a diagonal position from the lower edge of the lower portion of the folded container towards the upper edge of the upper portion of the folded container.

10. The collapsible shipping container according to claim 9, wherein there are two diagonal locking elements and when the corresponding upper ends of these diagonal locking elements are rotated towards the horizontal side edge of the upper wall, the two diagonal locking elements adopt a San Andres cross shape corresponding to the working position, shipping container folded.

* * * * *